US012534163B1

(12) United States Patent
Hohenstein

(10) Patent No.: US 12,534,163 B1
(45) Date of Patent: Jan. 27, 2026

(54) VERSATILE SURFBOARD RACK

(71) Applicant: Radd Raxx Surf Company, LLC, Lincoln, NE (US)

(72) Inventor: Kurt Hohenstein, Lincoln, NE (US)

( * ) Notice: Subject to any disclaimer, the term of this patent is extended or adjusted under 35 U.S.C. 154(b) by 0 days.

(21) Appl. No.: 19/265,195

(22) Filed: Jul. 10, 2025

(51) Int. Cl.
*B63B 32/83* (2020.01)

(52) U.S. Cl.
CPC ..... *B63B 32/83* (2020.02)

(58) Field of Classification Search
CPC .. B63B 1/00; B63B 1/04; B63B 1/041; B63B 1/042; B63B 1/047; B63B 1/06; B63B 1/063; B63B 1/08; B63B 1/10; B63B 1/107; B63B 1/12; B63B 1/121; B63B 1/125; B63B 1/14; B63B 1/16; B63B 1/18; B63B 1/20; B63B 1/22; B63B 1/24; B63B 1/242; B63B 1/244; B63B 1/246; B63B 1/248; B63B 1/26; B63B 1/28; B63B 1/283; B63B 1/285; B63B 1/286; B63B 1/30; B63B 1/32; B63B 1/322; B63B 1/34; B63B 1/36; B63B 1/38; B63B 1/40; B63B 11/00; B63B 11/02; B63B 11/04; B63B 11/06; B63B 13/00; B63B 13/02; B63B 15/00; B63B 15/0083; B63B 15/02; B63B 17/00; B63B 17/0018; B63B 17/0081; B63B 17/02; B63B 17/04; B63B 19/00; B63B 19/08; B63B 19/14; B63B 2001/044; B63B 2001/045; B63B 2001/102; B63B 2001/123; B63B 2001/126; B63B 2001/128; B63B 2001/145; B63B 2001/186; B63B 2001/201; B63B 2001/202; B63B 2001/204; B63B 2001/206; B63B 2001/208; B63B 2001/281; B63B 2001/325; B63B 2001/345; B63B 2001/387; B63B 2003/085; B63B 2003/147; B63B 2003/382; B63B 2003/385; B63B 2003/387; B63B 2003/485; B63B 2005/242; B63B 2007/003; B63B 2007/006; B63B 2015/0025; B63B 2015/0033; B63B 2015/0041; B63B 2015/0058; B63B 2015/0066; B63B 2015/0075;
(Continued)

(56) References Cited

U.S. PATENT DOCUMENTS 5,033,497 A * 7/1991 Hernandez ..... E04H 15/30 441/74
5,997,376 A 12/1999 Block et al.
(Continued)

FOREIGN PATENT DOCUMENTS

AU 2012265576 A1 * 8/2013 ..... A45F 4/06
AU 2014202656 A1 * 12/2014 ..... A45C 13/03
(Continued)

*Primary Examiner* — Anthony D Stashick
*Assistant Examiner* — Marcos Javier Rodriguez Molina
(74) *Attorney, Agent, or Firm* — Stonebridge IP, PLLC

(57) ABSTRACT

A surfboard rack including a convex-shaped cradle ranging from about 1 foot to 3 feet wide and about 1 foot and about 5 feet long configured to hold up to about one third to three quarters the length of a surfboard, a girdle including a fastening mechanism configured to wrap around the cradle while holding the surfboard, a hanging mechanism for hanging the convex-shaped cradle on the surfboard rack.

11 Claims, 3 Drawing Sheets

(58) Field of Classification Search
CPC .... B63B 2017/0009; B63B 2017/0045; B63B 2017/0054; B63B 2017/0072; B63B 2017/009; B63B 2017/026; B63B 2017/045; B63B 2019/086; B63B 2021/001; B63B 2021/003; B63B 2021/005; B63B 2021/007; B63B 2021/008; B63B 2021/203; B63B 2021/206; B63B 2021/262; B63B 2021/501; B63B 2021/505; B63B 2021/566; B63B 2022/006; B63B 2022/028; B63B 2025/087; B63B 2025/245; B63B 2025/285; B63B 2027/141; B63B 2027/145; B63B 2027/165; B63B 2029/022; B63B 2029/043; B63B 2035/001; B63B 2035/002; B63B 2035/006; B63B 2035/007; B63B 2035/008; B63B 2035/009; B63B 2035/442; B63B 2035/4426; B63B 2035/444; B63B 2035/4446; B63B 2035/4453; B63B 2035/446; B63B 2035/4466; B63B 2035/4473; B63B 2035/4486; B63B 2039/063; B63B 2039/065; B63B 2039/066; B63B 2039/067; B63B 2039/068; B63B 2041/003; B63B 2043/006; B63B 2043/047; B63B 2043/126; B63B 2043/145; B63B 2045/005; B63B 2059/025; B63B 2059/065; B63B 2059/087; B63B 21/00; B63B 21/02; B63B 21/04; B63B 21/06; B63B 21/08; B63B 21/10; B63B 21/16; B63B 21/20; B63B 21/22; B63B 21/24; B63B 21/27; B63B 21/34; B63B 21/46; B63B 21/50; B63B 21/507; B63B 21/54; B63B 21/56; B63B 21/58; B63B 21/60; B63B 21/64; B63B 21/66; B63B 21/663; B63B 22/00; B63B 22/02; B63B 22/021; B63B 22/023; B63B 22/025; B63B 22/026; B63B 22/04; B63B 22/06; B63B 22/08; B63B 22/12; B63B 22/14; B63B 22/16; B63B 22/166; B63B 22/18; B63B 22/20; B63B 22/22; B63B 22/24; B63B 22/26; B63B 2201/00; B63B 2201/02; B63B 2201/04; B63B 2201/08; B63B 2201/12; B63B 2201/16; B63B 2201/18; B63B 2201/20; B63B 2201/26; B63B 2203/00; B63B 2205/00; B63B 2205/06; B63B 2205/08; B63B 2207/00; B63B 2207/02; B63B 2207/04; B63B 2209/14; B63B 2209/16; B63B 2209/18; B63B 2211/00; B63B 2211/02; B63B 2213/00; B63B 2213/02; B63B 2221/00; B63B 2221/02; B63B 2221/06; B63B 2221/08; B63B 2221/10; B63B 2221/12; B63B 2221/16; B63B 2221/18; B63B 2221/20; B63B 2221/22; B63B 2221/24; B63B 2231/00; B63B 2231/02; B63B 2231/04; B63B 2231/10; B63B 2231/30; B63B 2231/32; B63B 2231/44; B63B 2231/50; B63B 2231/52; B63B 2241/02; B63B 2241/06; B63B 2241/08; B63B 2241/20; B63B 2241/24; B63B 23/00; B63B 23/02; B63B 23/04; B63B 23/06; B63B 23/08; B63B 23/10; B63B 23/16; B63B 23/18; B63B 23/26; B63B 23/28; B63B 23/30; B63B 23/32; B63B 23/34; B63B 23/36; B63B 23/38; B63B 23/40; B63B 23/48; B63B 23/52; B63B 23/58; B63B 23/60; B63B 23/62; B63B 23/64; B63B 23/66; B63B 25/00; B63B 25/002; B63B 25/004; B63B 25/006; B63B 25/008; B63B 25/02; B63B 25/04; B63B 25/08; B63B 25/082; B63B 25/10; B63B 25/12; B63B 25/14; B63B 25/16; B63B 25/18; B63B 25/22; B63B 25/24; B63B 25/28; B63B 27/00; B63B 27/04; B63B 27/06; B63B 27/08; B63B 27/10; B63B 27/12; B63B 27/14; B63B 27/143; B63B 27/146; B63B 27/16; B63B 27/18; B63B 27/19; B63B 27/22; B63B 27/24; B63B 27/25; B63B 27/28; B63B 27/29; B63B 27/30; B63B 27/32; B63B 27/34; B63B 27/36; B63B 29/00; B63B 29/02; B63B 29/04; B63B 29/10; B63B 29/12; B63B 29/16; B63B 29/20; B63B 3/00; B63B 3/02; B63B 3/04; B63B 3/06; B63B 3/08; B63B 3/10; B63B 3/13; B63B 3/14; B63B 3/142; B63B 3/20; B63B 3/26; B63B 3/34; B63B 3/38; B63B 3/40; B63B 3/46; B63B 3/48; B63B 3/56; B63B 3/68; B63B 3/70; B63B 32/00; B63B 32/10; B63B 32/22; B63B 32/30; B63B 32/35; B63B 32/40; B63B 32/45; B63B 32/47; B63B 32/50; B63B 32/51; B63B 32/53; B63B 32/55; B63B 32/56; B63B 32/57; B63B 32/59; B63B 32/60; B63B 32/62; B63B 32/64; B63B 32/66; B63B 32/68; B63B 32/70; B63B 32/73; B63B 32/77; B63B 32/80; B63B 32/83; B63B 32/87; B63B 34/00; B63B 34/05; B63B 34/10; B63B 34/15; B63B 34/20; B63B 34/21; B63B 34/22; B63B 34/23; B63B 34/26; B63B 34/30; B63B 34/40; B63B 34/45; B63B 34/50; B63B 34/52; B63B 34/54; B63B 34/56; B63B 34/565; B63B 34/60; B63B 34/63; B63B 34/67; B63B 34/70; B63B 34/75; B63B 35/00; B63B 35/003; B63B 35/03; B63B 35/04; B63B 35/08; B63B 35/086; B63B 35/14; B63B 35/28; B63B 35/303; B63B 35/32; B63B 35/34; B63B 35/38; B63B 35/40; B63B 35/42; B63B 35/44; B63B 35/4406; B63B 35/4413; B63B 35/50; B63B 35/52; B63B 35/58; B63B 35/62; B63B 35/66; B63B 35/665; B63B 35/68; B63B 35/70; B63B 39/00; B63B 39/005; B63B 39/02; B63B 39/03; B63B 39/06; B63B 39/061; B63B 39/062; B63B 39/08; B63B 39/10; B63B 39/12; B63B 39/14; B63B 41/00; B63B 43/00; B63B 43/02; B63B 43/04; B63B 43/06; B63B 43/10; B63B 43/12; B63B 43/14; B63B 43/16; B63B 43/18; B63B 43/20; B63B 43/24; B63B 45/00; B63B 45/02; B63B 45/04; B63B 45/06; B63B 45/08; B63B 49/00; B63B 5/00; B63B 5/18; B63B 5/24; B63B 59/00; B63B 59/02; B63B 59/04; B63B 59/06; B63B 59/08; B63B 59/10; B63B 69/00; B63B 7/00; B63B 7/02; B63B 7/04; B63B 7/06;

B63B 7/08; B63B 7/082; B63B 7/085; B63B 7/087; B63B 71/00; B63B 71/20; B63B 73/00; B63B 73/10; B63B 73/20; B63B 73/30; B63B 73/40; B63B 73/43; B63B 73/46; B63B 73/49; B63B 73/50; B63B 73/60; B63B 73/70; B63B 73/72; B63B 73/74; B63B 75/00; B63B 77/00; B63B 77/10; B63B 79/00; B63B 79/10; B63B 79/15; B63B 79/20; B63B 79/30; B63B 79/40; B63B 81/00; B63B 85/00; B63B 2260/021; B63B 2262/0253; B63B 2262/0269; B63B 2307/54; B63B 2307/56; B63B 2307/581; B63B 2307/72; B63B 2307/732; B63B 2439/00; B63B 2439/46; B63B 2571/02; B63B 3/266; B63B 5/024; B63B 5/028; B63B 5/12; B63B 5/245; B63B 5/262; B63B 2231/34; B63B 2231/40; B63B 32/20; B63B 35/73; B63B 35/79; B63B 35/7926; B63B 35/7933; B63B 35/7946; A44B 11/04; A44B 11/065; A45C 11/00; A45C 11/002; A45C 11/24; A45C 13/00; A45C 13/001; A45C 13/02; A45C 13/021; A45C 13/03; A45C 13/103; A45C 13/26; A45C 13/36; A45C 15/00; A45C 2003/007; A45C 3/00; A45C 3/001; A45C 5/14; A45C 5/143; A45C 7/0018; A45C 7/0022; A45C 7/0036; A45C 7/0077; A45C 7/0086; A45C 7/009; A45C 9/00; A45F 2003/003; A45F 2200/05; A45F 3/00; A45F 3/02; A45F 3/04; A45F 3/15; A45F 4/04; A45F 4/06; A45F 5/0006; A63C 11/023; A63C 5/03; B63J 99/00; B65B 23/00; B65D 2585/649; B65D 81/03; B65D 81/052; B65D 85/00; B65G 1/0457; B66D 2700/023; B66D 2700/026; B66D 2700/05; B66D 3/04; B66D 3/043; B66D 3/08; D03D 15/20; E04H 15/30; Y10S 224/917

USPC ..... 206/1.5, 1.7, 139, 163, 170, 174, 201, 206/203, 216, 219, 222, 233, 278, 282, 206/287, 287.1, 289, 291, 292, 298, 314, 206/315.1, 315.11, 315.2, 315.3, 315.4, 206/315.5, 315.6, 315.7, 315.9, 315.91, 206/317, 318, 319, 320, 335, 366, 37, 206/373, 374, 38, 386, 390, 391, 392, 206/394, 395, 397, 398, 407, 408, 409, 206/418, 423, 424, 427, 429, 431, 433, 206/436, 443, 446, 448, 449, 45.22, 454, 206/457, 459.1, 459.5, 460, 462, 464, 206/466, 471, 474, 485, 486, 494, 495, 206/497, 499, 503, 504, 507, 508, 509, 206/511, 512, 515, 518, 521, 521.1, 206/521.2, 522, 523, 524.1, 524.7, 524.8, 206/525, 525.1, 526, 540, 557, 558, 561, 206/564, 570, 575, 576, 579, 583, 585, 206/586, 587, 588, 589, 590, 591, 592, 206/593, 594, 597, 598, 599, 600, 722, 206/723, 727, 742, 743, 77.1, 778, 8, 206/804, 806, 807, 811, 820, 821, 822; 220/1.5, 200, 201, 202, 203.16, 203.17, 220/212, 23.4, 23.6, 23.83, 23.86, 23.88, 220/230, 231, 232, 261, 309.1, 310.1, 220/315, 324, 326, 345.3, 345.6, 349, 220/351, 376, 380, 4.16, 4.21, 4.22, 4.23, 220/4.26, 4.27, 4.28, 4.33, 501, 505, 507, 220/523, 524, 528, 553, 557, 560, 560.05, 220/560.07, 560.09, 560.12, 562, 564, 220/565, 567.1, 567.2, 586, 592, 592.17, 220/6, 62.11, 62.12, 62.14, 62.22, 628, 220/629, 649, 659, 660, 669, 670, 681, 220/694, 7, 714, 721, 729, 735, 759, 799, 220/8, 810, 86.1, 88.1, 901, 902, 14, 220/DIG. 24, DIG. 30, DIG. 9; 114/79 R; 135/95; 224/309, 901.4, 917, 917.5; 383/25, 40; 441/74; 442/186; D21/766

See application file for complete search history.

(56) References Cited

U.S. PATENT DOCUMENTS

| | | | | | |
|---|---|---|---|---|---|
| 6,003,745 | A * | 12/1999 | Mechanic | ..... | A45C 9/00 5/420 |
| 10,946,805 | B2 | 3/2021 | Skoff | | |
| 2006/0283532 | A1* | 12/2006 | Ibanez | ..... | B63B 32/87 150/154 |
| 2006/0289584 | A1* | 12/2006 | Lu | ..... | A45C 7/009 224/616 |
| 2014/0339109 | A1* | 11/2014 | Van Emden | ..... | B65B 23/00 53/446 |
| 2019/0002063 | A1 | 1/2019 | Rohrer | | |
| 2022/0079312 | A1* | 3/2022 | Bladd-Symms | ..... | A45C 5/14 |

FOREIGN PATENT DOCUMENTS

| | | | | | |
|---|---|---|---|---|---|
| DE | 3639296 | A * | 4/1988 | ..... | B63B 43/14 |
| DE | 3804364 | C1 * | 5/1989 | ..... | B66D 3/04 |
| DE | 202004012215 | U1 * | 10/2004 | ..... | A45C 11/24 |
| FR | 2490597 | A * | 3/1982 | ..... | B63B 32/87 |

* cited by examiner

VERSATILE SURFBOARD RACK

BACKGROUND

Technical Field of the Invention

The field of this invention is surfboard racks or surfboard holders.

Description of the Related Art

Surfboard racks are generally fixed objects. A surfboard may be hung upright, hung from a ceiling, or placed horizontally against a wall. Currently available surfboard racks generally do not move and do not provide options for expansion. Currently available surfboard racks can generally handle only 3 or 4 surfboards at the most.

Accordingly, improved surfboard racks that can handle a greater number of surfboards, which do not need to be mounted to a wall, and that take up less space would provide significant improvements to current technology.

SUMMARY DISCLOSURE OF THE INVENTION

A surfboard rack including a convex-shaped cradle ranging from about 1 foot to 3 feet wide and about 1 foot and about 4 feet long configured to hold up to about one third to three quarters the length of a surfboard (or more), a girdle, including a fastening mechanism, configured to wrap around the cradle while holding the surfboard, and a hanging mechanism for hanging the convex-shaped cradle on a surfboard rack.

In embodiments, the convex-shaped cradle comprises high density foam. In embodiments, the fastening mechanism includes a zipper. In embodiments, the girdle includes neoprene. In embodiments, the girdle wraps substantially around the entirety of the convex-shaped cradle. In embodiments, the rack includes a track, and a translation mechanism configured to translate the cradle and girdle holding a surfboard along the track. In embodiments, the translation mechanism includes wheels.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DISCLOSURE OF THE INVENTION

The following detailed description is provided to assist the reader in gaining a comprehensive understanding of the methods, products, and/or systems described herein. However, various changes, modifications, and equivalents of the methods, products, and/or systems described herein will be apparent to an ordinary skilled artisan.

MODES FOR CARRYING OUT THE INVENTION

The present invention provides a surfboard rack that includes a cradle that hangs from a mount of the rack and that can be slid along a channel or translation mechanism of a track of the rack. In embodiments, ten surfboards can be hung in a space of about 48 inches. When hung, each board can be moved right to left and articulated 360°. One (foam board) cradle can be used for each surfboard. Each surfboard is secured to the cradle by a girdle. In embodiments, the girdle may be a neoprene girdle. In embodiments, the girdle wraps around the cradle and can be zipped securing the board tightly against the cradle preventing any slippage. In embodiments, the surfboard rack can be mounted between two walls, from the ceiling, outward from a wall, or from the floor. The distance from a wall mount to the rack can be 10 inches.

The cradle can have a convex shape and be shaped similarly to the top ⅓ of a surfboard. That is, with a rounded (or pointed) top that gradually curves outward on both sides to a maximum width roughly the width of a surfboard. In embodiments, the cradle may range anywhere from 1 foot to 3 feet wide and from 1 foot to 5 feet in length. The cradle includes an outer rim on one side that extends along the periphery of the cradle. The cradle can be generally flat on the other (back) side. The rim generally extends from the top of the cradle and along both outwardly sloping sides stopping at or near the bottom. The rim would not be present along the bottom of the cradle. The cradle and rim can be made from high density foam and/or neoprene, and could also include lightweight plastic, PVC (polyvinyl chloride) molded into the foam board shape, light weight wood, and rubber.

Figure 1:
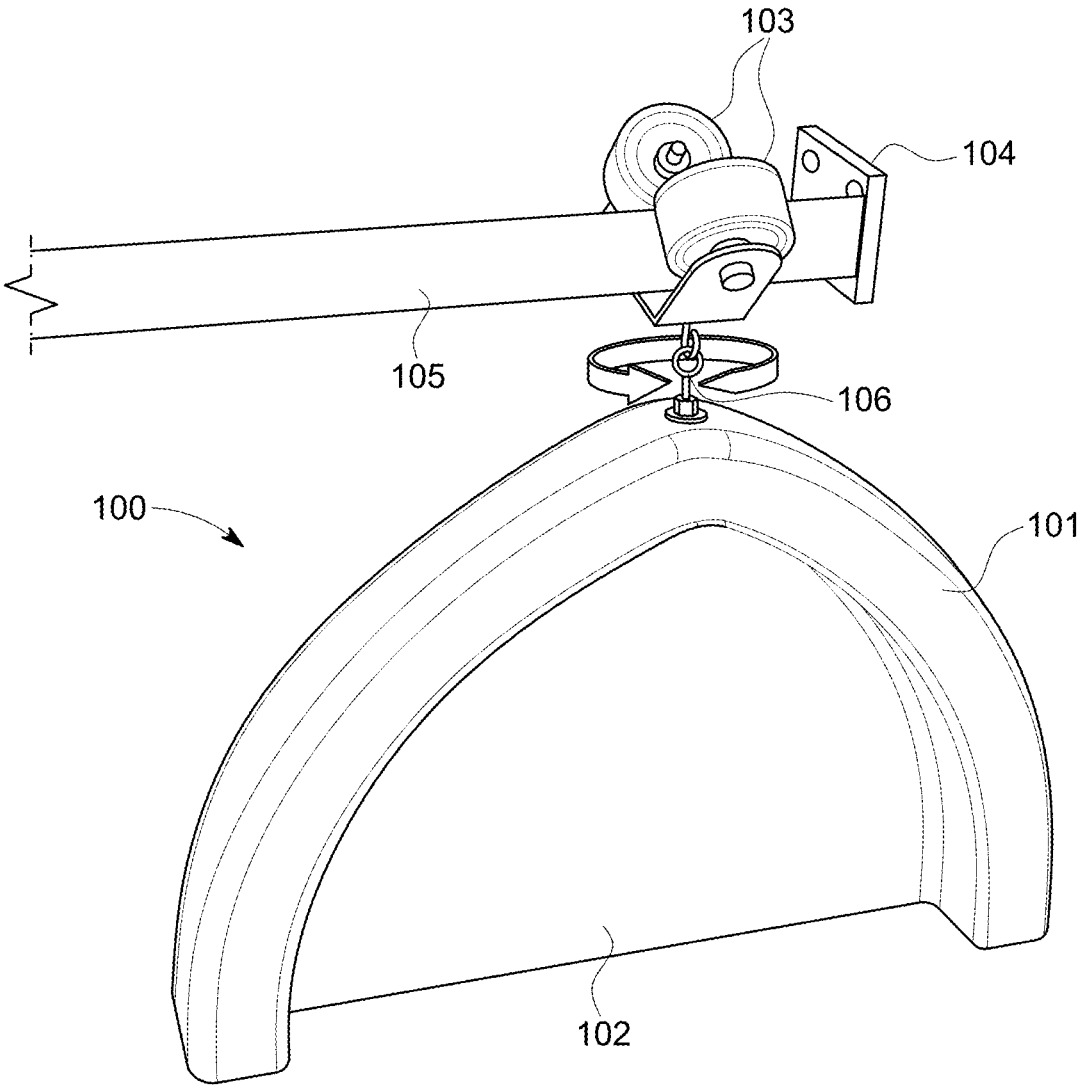
FIG. 1 shows an exemplary surfboard rack of the disclosure.

FIG. 1 shows an exemplary convex shaped cradle 100 of the disclosure. FIG. 1 shows cradle rim 101, cradle back 102, and cradle mount 106. FIG. 1 also shows wheels 103, wall mount 104, and track 105 for mounting, sliding, and articulating or rotating the cradle. FIG. 1 shows that the cradle can be rotated or spun 360 degrees as indicated by the arrow.

In embodiments, the cradle can range from about 1 foot to about 3 feet in width and about 1 foot to about 5 feet in length. The rim can range from about 1 inch to about 6 inches wide and about 1 inch to about 10 inches deep or about 1 to about 6 inches deep. In embodiments, the rim can be about 2 to about 4 inches deep or about 3 to about 6 inches deep. Generally, the rim holds the surfboard and can be made from any material that can retain its shape while holding a surfboard and after a surfboard is removed. The rim can be made from the same material as the back of the cradle or of a different material. The rim can thus be separate from the back of the cradle and attached to the cradle or can be integrally formed with the cradle.

Figure 2:
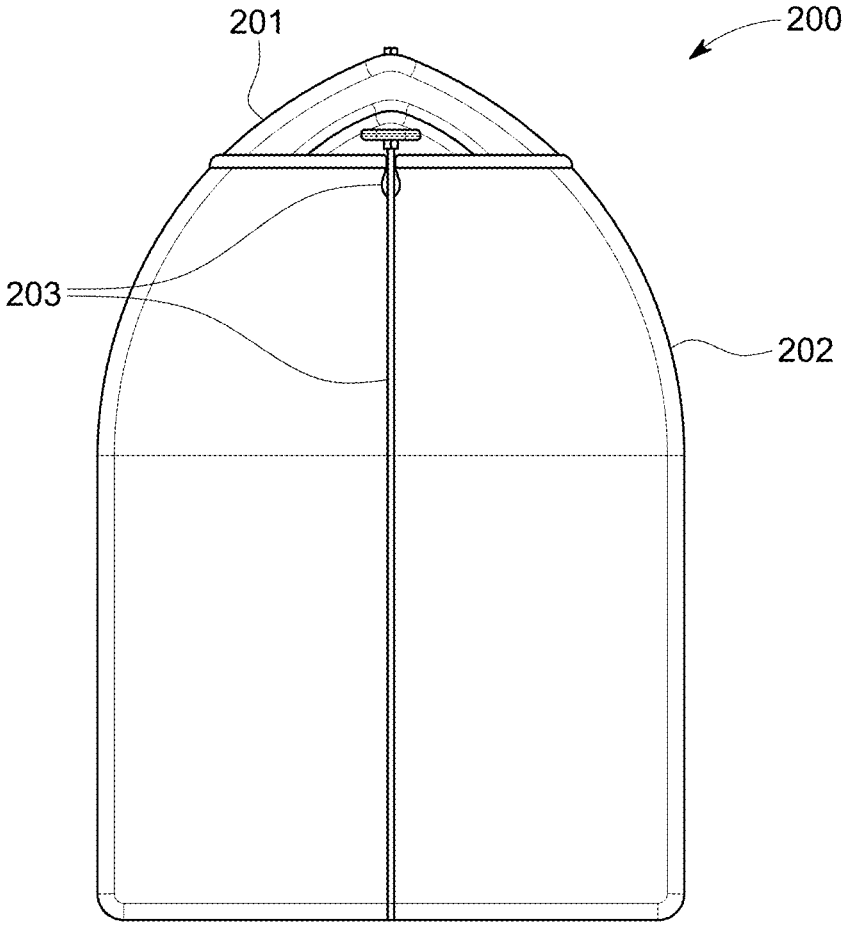
FIG. 2 shows an exemplary cradle of the disclosure wrapped with a girdle.

The surfboard rack further includes a girdle that is used in conjunction with the cradle. In embodiments, the girdle wraps around the cradle and includes a zipper that when zipped wraps tight around the cradle (and surfboard). When in use, the girdle securely holds a surfboard in the cradle in place. The girdle thus allows a surfboard to be securely hung from the cradle. A user can mount a surfboard into the cradle and then secure it with the girdle. In embodiments, the girdle can be made from neoprene, but any other appropriate material is contemplated. FIG. 2 shows a cradle with a girdle wrapped securely around it. FIG. 2 shows cradle 201, girdle 202, and zipper 203.

Figure 3:
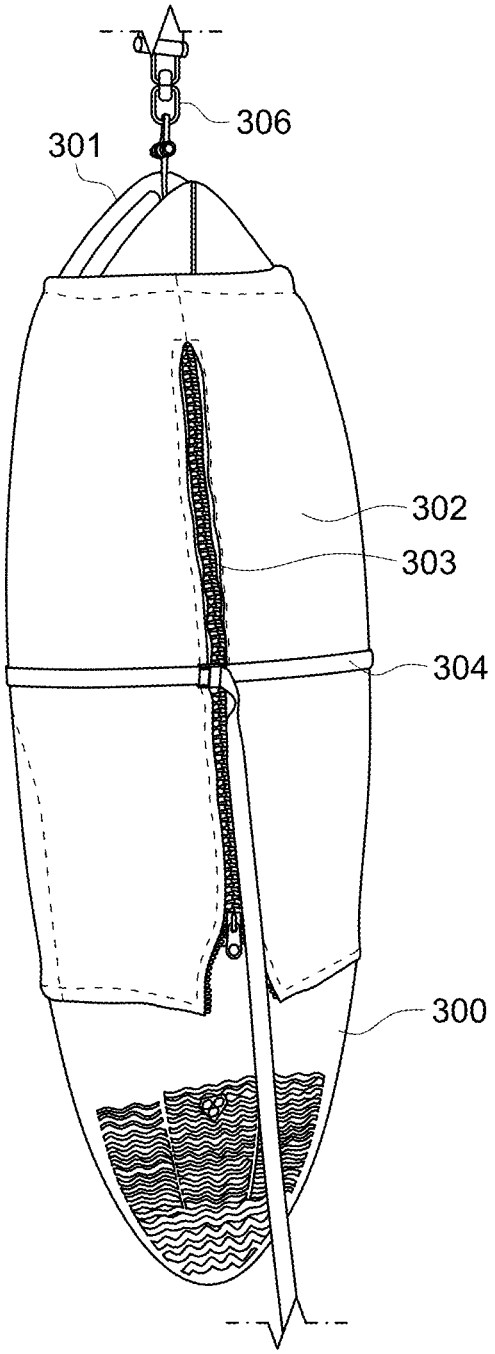
FIG. 3 shows an exemplary cradle and girdle of the disclosure holding a surfboard.

FIG. 3 shows a cradle 301 with surfboard 300 attached, girdle 302, and cradle mount 306. FIG. 3 additionally shows zipper 303 and strap 304 to further secure the surfboard to the cradle.

A zipper pulls the girdle around the board and cradle, but a nylon strap can also be used to secure the board to the girdle. A strap system can also be used to hold the board to the girdle, either nylon or butyl rubber. A snap or button system can also be used if placed at ideal locations affixed to the material used for the girdle.

In one example, the cradle can be hung with a metal eyebolt and a metal hanger affixed to a skate strap. Both of those pieces rotate 360 degrees horizontally, but also allow the board cradle to be moved forward and backward, right, and left, and completely out of the way as other boards are moved into position. The two skate wheels sit on the slide track to allow ease of movement. See FIG. 1. Alternatively, using a different slide track shaped more like an inverted T, a trolly system could be used to move the cradle on the track. Alternatively, a system with a wire strung from two walls could be used, and the board would be moved in any direction by a device secured to a wheel with a channel in which the wire sits. The single wheel would be used instead of the two skate wheel strap on the board slide guide. Generally speaking, similarly functioning systems for translation known in the art are also contemplated.

This invention could also be adapted to hang snow boards, snow skis and water skis. In those instances, the cradle would be substantially narrower and shorter due to the different sizes of those sports boards. An exemplary design and size of the board cradles was chosen to match the majority of surfboards currently available.

The surfboard can also be raised up to a zig zag cleat which can be glued and screwed with two screws onto the front of the board cradle about 6 inches from the top on the inside. A zig zag cleat is designed to allow the surfer to easily lift the board with a "Lift Leash" (described below) using one hand and hold the board temporarily until the zipper can be zipped down securing the board. Zig zag cleats are known in the art and are used, for example, in boating to secure anchors, bow lines, safety lines, etc. Generally, any piece that allows a rope from the lift leash to hold the board in place while the zipper is zipped down can be used.

The lift leash can be made from a piece of 1 to 2 inch butyl rubber material approximately 1/16' thick which is long enough to go around a typical surfboard at the location ⅓ of the distance from the top of the board. In one embodiment, 20-24" of butyl rubber material can be used. That material is crossed over and a nylon rope (⅜" thick and 6 feet long). Glue can be added, and the butyl rubber straps cross over, and the nylon rope lays in the straps. A rope clamp is then clamped around both the rope and two pieces of rubber. The "Lift Leash" can be provided with each board cradle.

There can also be a nylon "Snug Strap" (½" to 1" wide) sewn around the board girdle located at the bottom of the board cradle that has a side release. This is used primarily for larger and heavier boards for added holding capacity. In embodiments, the Snug Strap can be flat nylon material and secured by a plastic or metal clamp that allows for tightening on both ends and is secured by pushing the two pieces on either side of the neoprene material together until it clicks.

In use, a user takes a surfboard and inserts one end of it into the cradle. With the surfboard held in the cradle, the girdle is wrapped around the cradle and the surfboard held therein, and zippered to securely hold the surfboard in the cradle. To remove the surfboard, the girdle zipper is unzipped, and the surfboard is removed.

Accordingly, a method of using the surfboard rack of the disclosure includes disposing one end of a surfboard into the cradle, wrapping a girdle around the cradle with the surfboard held therein, and securing the surfboard held within the cradle with the girdle, for example, by zippering the girdle.

In embodiments, the surfboard rack further includes a mount and track for hanging a cradle and girdle and associated surfboard. The mount and track can include a hanging mechanism, e.g., hook or the like, for hanging the cradle and a roller mechanism to allow a cradle to be hung from and rolled along a track. In embodiments, the rolling mechanism can include wheels for rolling the cradle along the track although any method of sliding a hanging cradle along a track or mount is contemplated.

In one example, shown in FIG. 1, an angled track is provided with wheels and a mounting bracket for a connector or leash to hold the cradle and girdle. Other similar rolling mechanisms for rolling and articulating a hanging structure known in the art are also contemplated.

GLOSSARY

High density foam is a medium quality industrial grade foam type that is offered in a range of firmness. High density foam returns to its original shape after compression. High density foam may have a density of between about 1.80-1.85 LBs/square foot (ASTM D 3574). The ILD (Indentation Load Deflection) can range from about 18 to about 86 (ASTM D 3574).

A surfboard is used herein as the term is commonly used, i.e., a board that is used by surfers in the sport of surfing. Surfboards can be made from wood, polyurethane, polystyrene, and can include fiberglass, polyester, and epoxy resins. Surfboards can generally range in length from About 5 feet to about 15 feet in length and in width from about 1 foot to about 3 feet. A surfboard length of 6 to 9 feet long; 1.5 feet to 2 feet wide and 1 to 6 inches thick is common. Thicknesses can be 2 to 4 inches.

A surfboard rack as used herein, generally refers to racks or structures that can hold a plurality of surfboards while not in use. In embodiments, a rack refers to a structure that includes a track or rails that can be configured to hold a plurality of surfboards by hanging the surfboards on the track or rail(s). The track or rail can be configured to include holders that can be slid or translated along the track and that can hold multiple cradles through leashes or chains, or the like, with hooks or other means to secure or hang the cradle. An example is shown in FIG. 1. The surfboard rack may be on a stand and be placed directly on the floor, or it may include plates attached to the track or rails that can be secured to a wall, as another example.

A girdle as used herein is a flat piece of material that can be wrapped around a cradle and secured. The width of the girdle can range from a few inches to about 6 feet in width or substantially as wide as the cradle. The girdle is necessarily long enough to wrap completely around the cradle and be fastened. Thus, the girdle can be optimally anywhere from about two feet to about 6 feet in length. The girdle can be made from any plastic or cloth like material that can be securely wrapped around the cradle. In embodiments, the girdle can be made of neoprene. The girdle can be secured around the cradle by various means, including a zipper, buttons, snaps, Velcro, hooks, belts and buckles, pressure fasteners, or any other means known in the art to securely attach the two ends of the girdle together when wrapped around the cradle. A zipper is preferred. The various attachment mechanisms also apply to the straps.

While neoprene is the preferred material for the girdle, any material that stretches tight can be used, including butyl rubber and any materials similar to neoprene with characteristics that allow the material to retain its form.

A hanging mechanism is generally any mechanism known in the art that can be used to hang a cradle from a track, rail, or rack. A leash with a hook, or a chain with a hook, snap, or other mechanism to attach and hang a cradle from a frame can be used. A mechanism with a hook is shown in FIG. 1 as an example.

The term consist of as used herein means a component is made completely of a stated material not excluding manufacturing impurities and the like. The term consist essentially of as used herein means that the component is made of the stated material but does not exclude additional material components that would not affect the essential mechanical characteristics of the component. For example, for the cradle that would refer to the capacity for the stated material (e.g., for the rim) to retain its shape in holding a surfboard.

While this disclosure includes specific examples, it will be apparent after an understanding of the disclosure of this application has been attained that various changes in form and details may be made in these examples without departing from the spirit and scope of the claims and their equivalents.

The invention claimed is:

1. A surfboard hanging system comprising:

a convex-shaped cradle comprising a rim comprising high density foam from between about 1 inch to about 10 inches deep configured to hold up to about one-third to about three-fourths a length of a 6 to 9 feet long surfboard, wherein the rim extends from a top of the convex-shaped cradle and along an outer edge of a both sides of the convex-shaped cradle stopping at or near a bottom of the convex-shaped cradle, and wherein the rim is not present along the bottom of the convex-shaped cradle;

a girdle comprising a fastening mechanism configured to wrap around the convex-shaped cradle while holding the 6 to 9 feet long surfboard;

a hanging mechanism attached to the top of the convex-shaped cradle for hanging the convex-shaped cradle;

a rack including a track, and a translation mechanism configured to translate the hanging mechanism, the convex-shaped cradle, the girdle, and the 6 to 9 feet long surfboard along the track;

wherein the convex-shaped cradle, the rim, the girdle, and the hanging mechanism are configured to simultaneously hold and hang the 6 to 9 feet long surfboard vertically from the rack.

2. The surfboard hanging system of claim 1, wherein the rim is integrally formed with the cradle.

3. The surfboard hanging system of claim 1, wherein the convex-shaped cradle and rim consist essentially of high density foam.

4. The surfboard hanging system of claim 2, wherein the convex-shaped cradle and rim consist essentially of high density foam.

5. The surfboard hanging system of claim 1, wherein the fastening mechanism comprises a zipper.

6. The surfboard hanging system of claim 1, wherein the girdle comprises neoprene.

7. The surfboard hanging system of claim 1, wherein the girdle wraps substantially around the entirety of the convex-shaped cradle.

8. The surfboard hanging system of claim 1, wherein the translation mechanism includes wheels.

9. A method of holding a 6 to 9 feet long surfboard on the surfboard hanging system of claim 1 comprising:

inserting one end of the 6 to 9 feet long surfboard into the convex-shaped cradle;

wrapping the girdle around the convex-shaped cradle to secure the 6 to 9 feet long surfboard;

fastening the girdle around the convex-shaped cradle; and vertically hanging the 6 to 9 feet long surfboard from the rack via the hanging mechanism.

10. The method of claim 9, wherein fastening the girdle comprises closing a zipper.

11. The surfboard hanging system of claim 1, wherein the convex-shaped cradle ranges from about 1 feet to about 3 feet wide and about 1 feet to about 5 feet long.

* * * * *